US006549223B2

(12) United States Patent
Yamauchi

(10) Patent No.: US 6,549,223 B2
(45) Date of Patent: Apr. 15, 2003

(54) ELECTROPHOTOGRAPHIC APPARATUS, PROCESS CARTRIDGE, AND ELECTROPHOTOGRAPHIC PHOTOSENSITIVE MEMBER

(75) Inventor: Kazumi Yamauchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/011,443

(22) Filed: Dec. 11, 2001

(65) Prior Publication Data

US 2002/0126196 A1 Sep. 12, 2002

(30) Foreign Application Priority Data

Dec. 12, 2000 (JP) ..... 2000-377710

(51) Int. Cl.[7] ..... G03G 15/00
(52) U.S. Cl. ..... 347/132; 347/140
(58) Field of Search ..... 347/129, 131, 347/132, 140, 233, 240; 430/58.05

(56) References Cited

U.S. PATENT DOCUMENTS 5,075,187 A * 12/1991 Karakida et al. ..... 430/57.4
5,910,386 A * 6/1999 Yoshinaga et al. ..... 430/66
6,219,076 B1 * 4/2001 Sato ..... 347/131
2002/0045116 A1 * 4/2002 Morikawa et al. ..... 430/66

FOREIGN PATENT DOCUMENTS

JP 3-52058 6/1988

* cited by examiner

*Primary Examiner*—Joan Pendegrass
(74) *Attorney, Agent, or Firm*—Fitzpatrick, Cella, Harper & Scinto

(57) ABSTRACT

An electrophotographic apparatus is provided having an electrophotographic photosensitive member and an exposure device for forming a static latent image on the electrophotographic photosensitive member surface by scanning with an exposure beam based on an image information. The spot diameter of the exposure beam is 2.5 times or more the size of one pixel of an image picture formed by the electrophotographic apparatus. The electrophotographic photosensitive member has the Fischer hardness of 240 $Ns/mm^2$ or more in its surface, and the NESA sensitivity of 2000 $V \cdot cm^2/\mu J$ or more, and is provided with an electric charge generating layer and an electric charge transportation layer 30 $\mu m$ or less thick.

15 Claims, 8 Drawing Sheets

$$i=\sqrt{x^2+h^2}$$

$$\frac{i}{h}=\sqrt{\left(\frac{x}{h}\right)^2+1}\cong 1\,(h\geqq x)$$

$$i\cong h$$

ELECTROPHOTOGRAPHIC APPARATUS, PROCESS CARTRIDGE, AND ELECTROPHOTOGRAPHIC PHOTOSENSITIVE MEMBER

FIELD OF THE INVENTION AND RELATED ARTS

The present invention relates to an electrophotographic apparatus and a process cartridge for a printer, a copying machine, or a facsimile machine.

In recent years, electrophotographic apparatus, such as a laser beam printer and an LED printer, are widely used. There is a increasing demand for low cost page printers with the spread of personal computers, and a laser beam method has an exposure control with more simple constitution compared with an LED method and can provide inexpensive electrophotographic apparatus. In addition, processing of photograph pictures can now be attained individually due to inexpensive high performance personal computers, and thus a high-resolution printer that can output photograph pictures is also demanded. Since office networks are progressed and two or more users use a printer simultaneously, improvement in its speed is required.

In high-resolution printers, a method of making the spot diameter of an exposure beam small to deal with high resolution has been adopted. When an exposure beam is made to provide a smaller diameter, the diameter of a proper spot is, for example, about 20 $\mu$m in 1200 dpi, and about 10 $\mu$m in 2400 dpi. In this case, the depth of focus of an exposure beam becomes shallow as the spot diameter becomes small, and hence, in order to form an image on a latent image holding member, a highly precise optical system is needed, which leads to a cost rise. Then, as a method of obtaining a higher pixel density with no cost rise of an optical system, a method is also adopted in which drive current of a light emitting device is weakened so that the output of exposure beams can become small without changing the spot diameter.

Moreover, when the resolution of a device or the process speed is made higher, the problem of a cost rise is brought about. This is because in laser beam printers, an increase in the number of rotation of a scanner needs a larger drive power source for rotation or reinforcement of the rotation support axis.

In order to cope with this problem, a multi-beam method is effective in which scanning is performed with two or more laser beams and static latent images for two or more lines can be simultaneously formed on an electrophotographic photosensitive member.

On the other hand, as an inexpensive charging equipment that charges an electrophotographic photosensitive member, a contact charging method is widely adopted. In this method, a high voltage power source and an ozone filter are not required, and simple constitution, such as a roller type, may be used also in charging members. In this method, uniform charging can be carried out using a method proposed by the inventor of the present invnetion in which voltage applied to contact charging member is oscillating voltage (Japanese Patent Publication No. 3-52058), especially a method in which an oscillating voltage peak value Vpp is two times or more as high as a charging starting voltage Vth when a direct current is applied to the charging member.

However, according to investigation by the inventor of the present invention, vertical streak-like image defects occurred in the second half of repetitive use durability test, when the output of exposure beams is made small to deal with high resolution at an accelerated process speed.

The state of image defects is shown in FIG. 15. Vertical streaks were fine white lines (a) generated at half-tone areas in photograph pictures or the like, and minute scratches (b) were present on the surface of an electrophotographic photosensitive member A corresponding to the streaks.

An explanation of this phenomenon will be given in FIG. 16. FIG. 16 shows an on-off signal of a laser and a static latent image pattern formed on the electrophotographic photosensitive member when a laser beam printer with the resolution of 1200 dpi and the spot diameter of 80 $\mu$m was used. The static latent image pattern was formed on the circumference of a section L shown in FIG. 15. The pattern used here for the static latent image pattern was a half tone of one-dot-two-space horizontal lines.

In a portion (c) where electrophotographic photosensitive member got damaged, when a laser beam is irradiated, irregular reflection occurs. Laser beams are reflected by irregular reflection from the electrophotographic photosensitive member surface, and as a result, the amount of light is reduced and insufficient to irradiate a charge-generating layer. Therefore, the potential does not fall to a dark portion potential and development cannot be effected, so that white lines occur.

This phenomenon becomes remarkable as the process speed becomes higher, because the rubbing power with members (for example, charging rollers, cleaning blades, etc.) in contact with the electrophotographic photosensitive member becomes stronger. Moreover, in high durable equipments, the streaks on the electrophotographic photosensitive member surface become gradually deeper and worse in their level.

SUMMARY OF THE INVENTION

The present invention was made in order to solve the above-described problems of prior art. An object of the present invention is to provide an electrophotographic apparatus having high resolution, in particular, forming images through scanning with a plurality of beams, which has an inexpensive structure and can output good photograph pictures without image defects such as white streaks even when the process speed is high; an electrophotographic photosensitive member used in the electrophotographic apparatus; and a process cartridge having the electrophotographic photosensitive member.

Another object of the present invention is to provide an electrophotographic apparatus, a process cartridge, and an electrophotographic photosensitive member which can keep the quality of photograph pictures high and have high durability.

Namely, the present invention provides an electrophotographic apparatus comprising an electrophotographic photosensitive member and an exposure means for forming a static latent image on the surface of the electrophotographic photosensitive member by scanning with an exposure beam based on image information, the spot diameter of the exposure beam being 2.5 times or more the size of one pixel of an image formed by the electrophotographic apparatus, wherein

- a Fischer hardness of the surface of the electrophotographic photosensitive member is no less than 240 $N/mm^2$,
- a NESA sensitivity of the electrophotographic photosensitive member is no less than 2000 $V \cdot cm^2/\mu J$, the electrophotographic photosensitive member has at least an electric charge generating layer and an electric charge transportation layer, and a thickness of the electric charge transportation layer is no more than 30 $\mu$m.

Further, the present invention provides a process cartridge which supports as one unit an electrophotographic photosensitive member in which a static latent image is formed on its surface by scanning with an exposure beam from an exposure means based on image information and at least one means selected from a group consisting of a developing means, a cleaning means, and a charging means, and can be mounted on, and detached from, the body of the electrophotographic apparatus, wherein a spot diameter of the exposure beam is 2.5 times or more the size of one pixel an image formed by the electrophotographic apparatus, a Fischer hardness of the surface of the electrophotographic photosensitive member is no less than 240 $N/mm^2$, a NESA sensitivity of the electrophotographic photosensitive member is no less than 2000 $V \cdot cm^2/\mu J$, the electrophotographic photosensitive member has at least an electric charge generating layer and an electric charge transportation layer, a thickness of the electric charge transportation layer is no more than 30 $\mu$m.

Moreover, the present invention provides an electrophotographic photosensitive member in which a static latent image is formed on its surface by scanning with an exposure beam from an exposure means based on image information, wherein a spot diameter of the exposure beam is 2.5 times the size of one pixel, a Fischer hardness of the surface of the electrophotographic photosensitive member is no less than 240 $N/mm^2$, a NESA sensitivity of the electrophotographic photosensitive member is no less than 2000 $V \cdot cm^2/\mu J$, the electrophotographic photosensitive member has at least an electric charge generating layer and an electric charge transportation layer, and a thickness of the electric charge transportation layer is no more than 30 $\mu$m.

DETAILED DESCRIPTION OF THE INVENTION

Terms used in the present invention, are defined as below.

The size of a pixel refers to a size obtained from pixel density and, for example, if the pixel density is 600 dpi, since one inch≅$2.54\times10^4$[$\mu$m], The size of a pixel is calculated as $2.54\times10^4/600=42.3$ [$\mu$m].

The spot diameter of an exposure beam refers to $1/e^2$ of the output maximum value of the exposure beam.

The Fischer hardness refers to a universal hardness calculated by performing the following Fischer hardness examinations:

In the Fischer hardness examination, load F is continuously applied to a Vickers penetrator to indent the electrophotographic photosensitive member surface and the resulting indentation depth h1 measures the hardness. The measurement conditions were set to be a load 50 mN and a load applying time 10 seconds under a 23° C./50% humidity environment. Load F and the resulting indentation depth hl were substituted in the following expression to calculate the universal hardness (HU):

$$HU=F/(26.43\times h1^2)$$

The NESA sensitivity was found from the quantity of light (Δ500) at the time that a photosensitive layer formed on NESA glass was charged to 700 (V), then irradiated with a light of 700 (nm) wavelength to become −200 (V).

The present invention will be described in more detail according to its specific embodiments, but by no means limited thereto.

EXAMPLE 1

Figure 1:
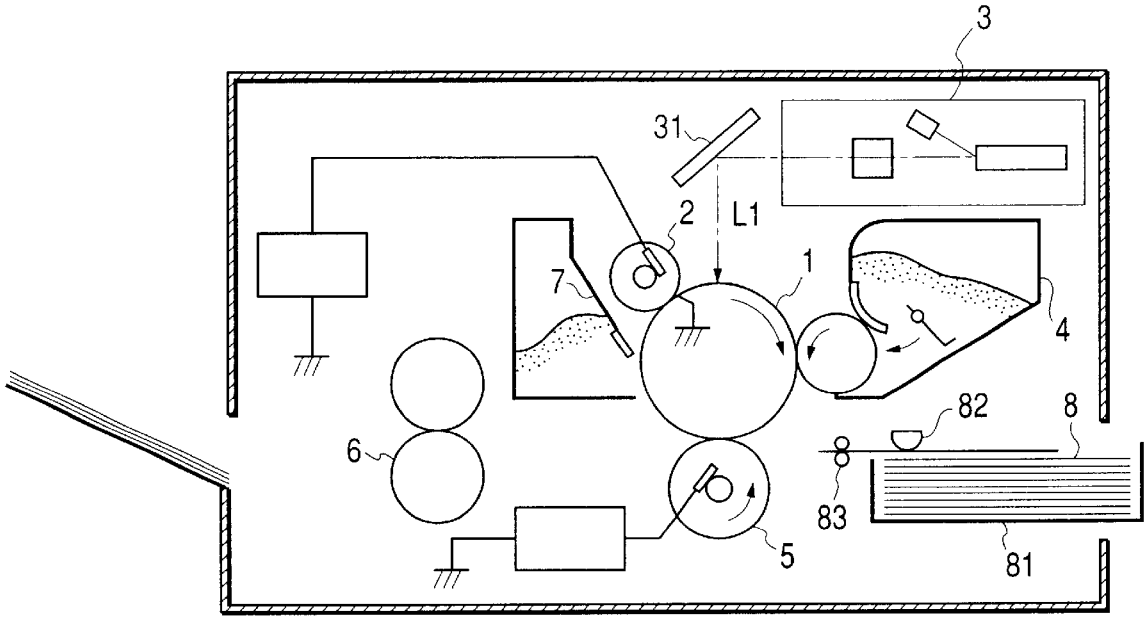
FIG. 1 is an outline block diagram representing the electrophotographic apparatus of the present invention.

An example of the electrophotographic apparatus of the present invention is shown in FIG. 1 with an outline constitution. The electrophotographic apparatus of the present invention is a laser beam printer using a contact charging method.

Reference numeral 1 denotes an electrophotographic photosensitive member of a rotation drum type as an image holding member, which is rotated at a predetermined circumferential speed (process speed) in the direction shown by an arrow. It has a basic constitution comprising a conductive support such as aluminum, and a photosensitive layer formed on the outer peripheral surface of the conductive support.

The electrophotographic photosensitive member 1 is uniformly charged by a contact charging equipment 2 consisting of a charging roller as a charging means.

Reference numeral 3 denotes a laser scanner unit. This unit contains a laser, and a polygon mirror correcting lens, etc., and when a signal is inputted into a printer from a host computer (not shown), a modulated laser light L1 in response to an electrical-signal image-signal in time series is outputted, and then the uniformly charged face of the electrophotographic photosensitive member 1 is scanned with an exposure light. Reference numeral 31 denotes a mirror that turns back the output laser light L1 from the laser scanner unit 3 onto the surface of the electrophotographic photosensitive member. By scanning with the laser light L1, a static latent image corresponding to the scanning is formed on the surface of the electrophotographic photosensitive member.

This static latent image is visualized as a toner image with a toner in a developing equipment 4 as a development means.

On the other hand, a recording medium 8 placed in a cassette 81 is supplied to a resist roller 83 by a paper delivery roller 82 synchronizing with latent image formation in the electrophotographic photosensitive member 1. This recording medium 8 is forwarded by the resist roller 83 to a transfer equipment 5 consisting of a transfer roller synchronizing with a head of the latent image formed on the electrophotographic photosensitive member 1, then the above-mentioned toner image is transferred by a transfer equipment 5 to the recording medium 8.

The recording medium 8 on which the toner image was transferred is finally discharged outside the apparatus, after permanent fixing of the toner image is carried out by fixing assembly 6. In addition, toner remained on the electrophotographic photosensitive member 1 is removed off by a cleaning equipment 7 of an elastic blade.

In the present invention, the spot diameter of an exposure beam is set to 2.5 times or more the size of one pixel in the above-mentioned laser printer. As a specific example, named is a device with the resolution of 1200 dpi and the process speed of 120 mm/s, in which a scanner unit having the spot diameter of an exposure beam of 80 $\mu$m is used and the quantity of laser light is so adjusted as to make a line width might proper. That is, the spot diameter of the exposure beam is about 3.8 times the size of one pixel of 21 $\mu$m, thus 1200 dpi is realized using an inexpensive constitution and not using a highly precise optical system.

The feature of the present invention is to use the following electrophotographic photosensitive members, when the above described electrophotographic apparatus with high resolution is used.

(1) a Fischer hardness is no less than 240 N/mm$^2$,
(2) a NESA sensitivity is no less than 2000 V·cm$^2$/$\mu$J,
(3) a thickness of an electric charge transportation layer is no more than 30 $\mu$m.

When the above-described high resolution apparatus with low-cost is used, and further even when the process speed of the apparatus is high, streaks in a half-tone image can be prevented from occurring by using such an electrophotographic photosensitive member, and a photograph picture with good quality can be reproduced.

Hereinafter, descriptions will be given based on FIG. 3.

Figure 3:
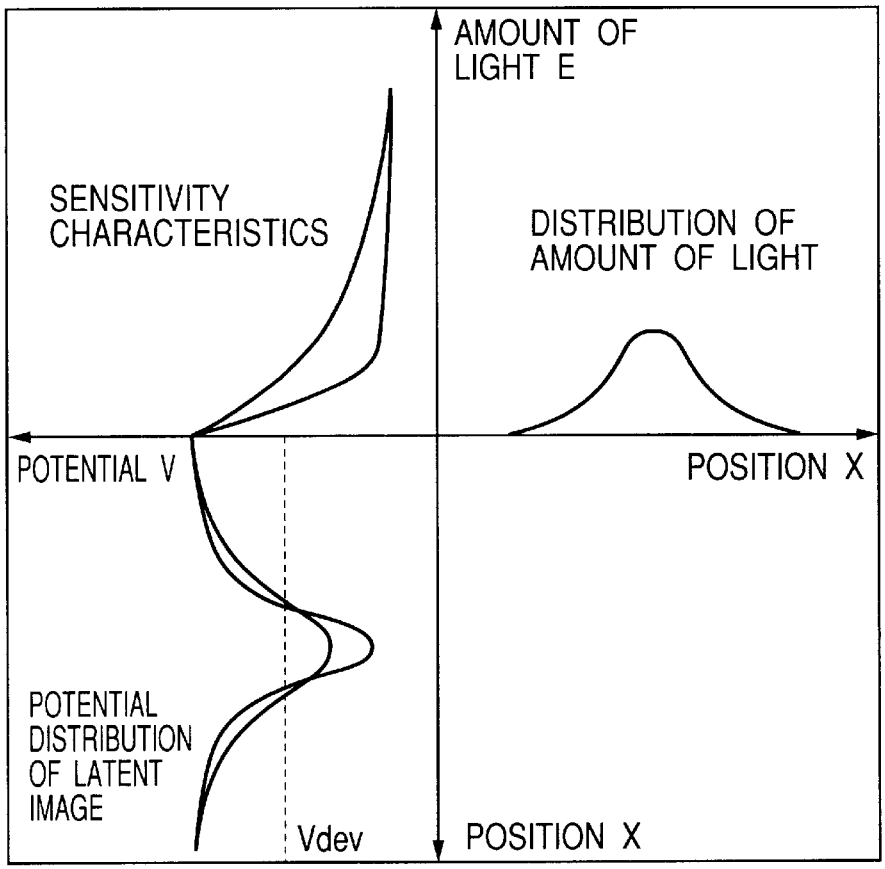
FIG. 3 is a figure explaining a static latent image pattern.

FIG. 3 is a graph showing a relationship among distribution of the amount of light of an exposure beam, sensitivity characteristics of an electrophotographic photosensitive member, and a static latent image formed on the electrophotographic photosensitive member. A first quadrant shows the distribution of the amount of light of the exposure beam, and the abscissa axis represents position x and the ordinate axis represents the amount of light E. A second quadrant shows the sensitivity characteristics of the electrophotographic photosensitive member, and the ordinate axis represents the amount of light E, and the abscissa axis represents potential V of the electrophotographic photosensitive member. A third quadrant shows potential in the static latent image distribution where projection was carried out on the basis of the distribution of the amount of light of the exposure beam plus the sensitivity characteristics of the electrophotographic photosensitive member, and the abscissa axis represents potential V and the ordinate axis represents position x.

Figure 4:
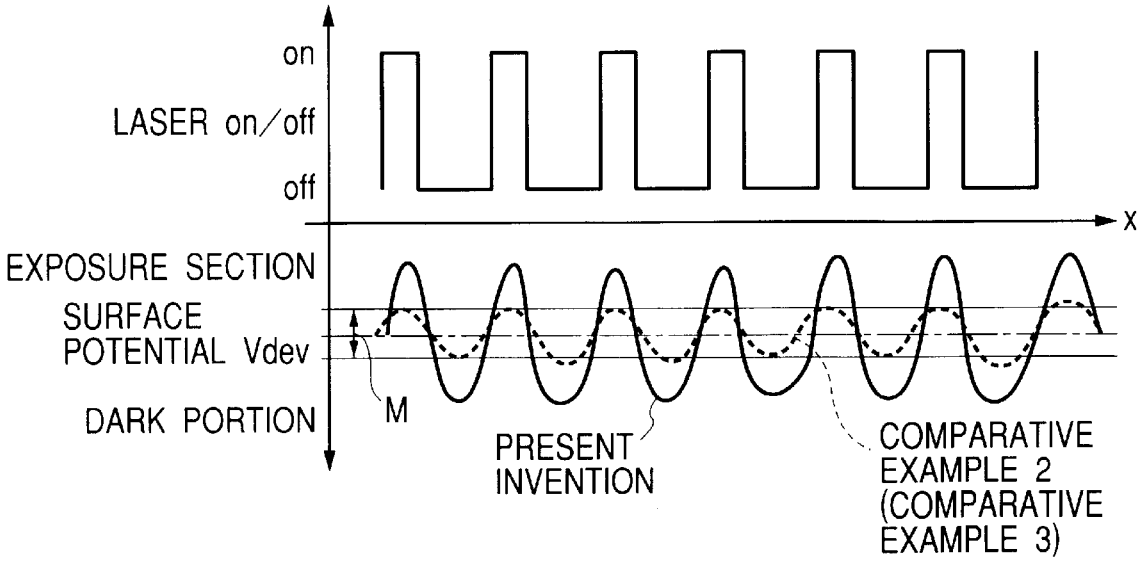
FIG. 4 is another figure explaining a static latent image pattern.

FIG. 4 shows an static latent image pattern formed with a half-tone image which was obtained on the basis of the above-described amount of light and potential of the electrophotographic photosensitive member. As comparative examples, a case (Comparative Example 2) where an NESA sensitivity is low and a case (Comparative Example 3) where an electric charge transportation layer is thick are shown. In half tone potential, if the NESA sensitivity becomes low, a potential area between dots may enter middle area M between a light portion potential and a dark portion potential. Since this area has the same level as development contrast, development with toner will be affected by noise received from a latent image. That is, streak-like image defects may occur in development even with a small variation of the amount of incident light as a result of irregular reflection due to a scratch on the electrophotographic photosensitive member surface etc.

Figure 5:
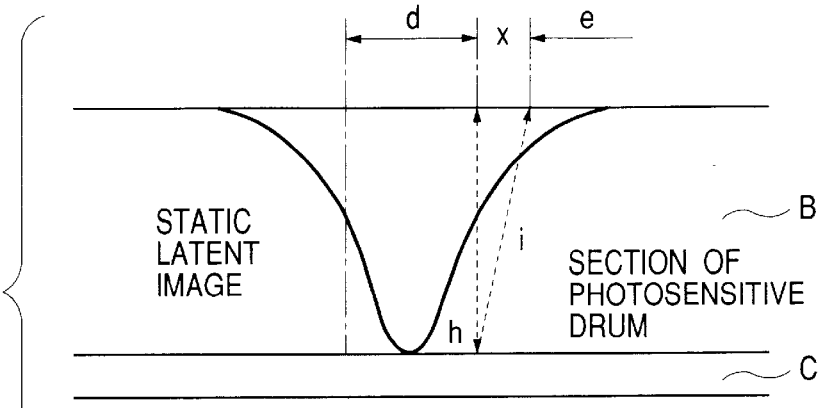
FIG. 5 is a still another figure explaining an static latent image pattern.

FIG. 5 shows the relationship between the thickness of an electric charge transportation layer B and the surface potential of an electrophotographic photosensitive member in a half tone image. Distance i between a laser irradiation section (d) and a proximity section (e) in an electric charge generating layer C approaches the thickness h of the electric charge transportation layer, as the thickness h of the electric charge transportation layer becomes thicker. Therefore, carriers produced in the electric charge-generating layer may lower a dark portion potential of the, proximity section (e). Therefore, the unevenness of surface potential in half tone potential may become low, and the middle area between light portion potential and dark portion potential may spread. Therefore, images with streak-like defects are liable to occur as in the case where the NESA sensitivity is low.

A model experiment was carried out in which a scratch with a depth of 1.0 $\mu$m was given to the electrophotographic photosensitive member surface and the output of a half tone image was performed with the above described electrophotographic apparatus. As a result of the examination by the present inventor, it became clear that the conditions in which streaks do not occur are the NESA sensitivity of no less than 2000 V·cm$^2$/$\mu$J and the thickness of the electric charge transportation layer of 30 $\mu$m.

Figure 6:
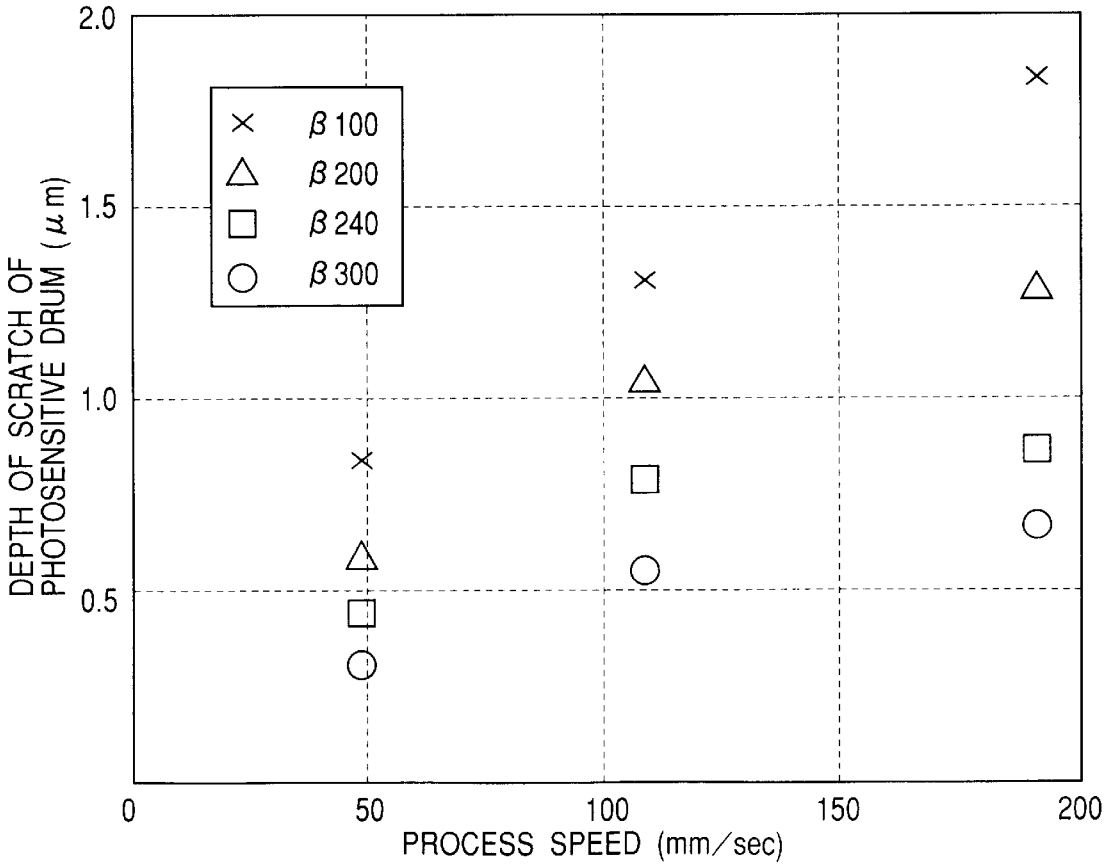
FIG. 6 is a figure explaining the relationship between a Fischer hardness and a scratch of an electrophotographic photosensitive member.

Moreover, the relationship between the Fischer hardness and a scratch occurring on the electrophotographic photosensitive member surface with high process speed is shown in FIG. 6. Here, after performing a durability test in which 10000 sheets are printed in a one-sheet intermittent mode (a mode in which a standstill time is set after printing one sheet) using the printer mentioned above, the depth of the scratch on the electrophotographic photosensitive member surface is measured with a contact roughness measuring instrument.

The graph shows that a higher process speed and a lower Fischer hardness give a deeper scratch on the electrophotographic photosensitive member surface. However, if the Fischer hardness is no less than 240 N/mm$^2$, even when the process speed is no less than 100 mm/s, the depth of a scratch on the electrophotographic photosensitive member is no more than 1.0 $\mu$m.

This means that even when the process speed is no less than 100 mm/s, if the spot diameter of the exposure beam is 2.5 times or more the size of one pixel, a significant effect is exhibited on prevention of images with streak-like defects by using the electrophotographic photosensitive member with (1) the Fischer hardness is no less than 240 $N/mm^2$ (2) the NESA sensitivity is no less than 2000 $V \cdot cm^2/\mu J$ (3) the thickness of the electric charge transportation layer is no more than 30 $\mu$m.

In addition, the Fischer hardness is preferably no more than 260 $N/mm^2$.

The NESA sensitivity is preferably no less than 3100 $V \cdot cm^2/\mu J$ and no more than 3600 $V \cdot cm^2/\mu J$.

The film thickness of the electric charge transportation layer is preferably no less than 18 $\mu$m.

Figure 2:
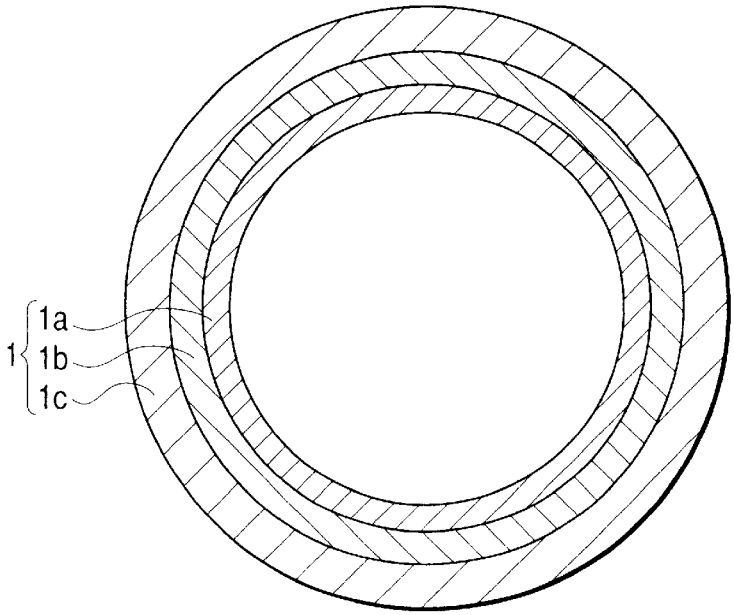
FIG. 2 is a sectional drawing of the electrophotographic photosensitive member used in the present invention.

Detailed description of the electrophotographic photosensitive member 1 of the present invention will be given with reference to FIG. 2. On a conductive support la, an electric charge generating layer 1*b* and an electric charge transportation layer 1*c* are sequentially laminated to form an electrophotographic photosensitive member.

The conductive support 1*a* is a drum or a sheet made of metal such as aluminum, chromium, nickel, copper, and stainless steel, is formed in a shape of a drum or a sheet, or made of plastics on which a metallic foil is laminated.

The electric charge generating layer 1*b* is formed in a way that a dispersion in which an electric charge generating material, such as phthalocyanine compounds and azo pigments, is dispersed in a binding resin, such as polyvinyl butyral, polyvinyl acetate and acrylics, is applied, or the above-mentioned pigment is applied by vacuum deposition. The film thickness of the electric charge generating layer 1*b* is preferably no less than 5 $\mu$m, and especially 0.05 to 3 $\mu$m.

The electric charge transportation layer 1*c* is formed using a coating liquid in which an electric charge transportation material having in its main chain or side chain a structure comprising a polycyclic aromatic compound such as biphenylene, anthracene, pyrene or phenanthrene, indole, carbazole, pyrazoline compounds, or styrene compounds, are dissolved in a film-forming resin. Polycarbonates etc. are named as such resins.

Hereinafter, specific examples will be described.

EXAMPLE 1—1

In an electrophotographic photosensitive member used in this example, an aluminum cylinder with a diameter of 30 mm and a length of 260 mm is used as a support. Four parts of a copolymerized polyamide was dissolved in a liquid mixture of 50 parts of methanol/50 parts of n-butanol, and then the cylinder was dipped in the solution obtained above so that the above-mentioned support was coated with the solution to form an undercoating of 0.6 $\mu$m.

Next, 8 parts of hydroxy titanium phthalocyanine pigment with a crystal form having a strong peak at 9.0 degrees, 14.2 degrees, 23.9 degrees and 27.1 degrees corresponding to the Bragg angle $2\theta \pm 0.2$ degrees in the CuK$\alpha$ characteristic X-ray diffraction eight parts, 2 parts of azo pigment and 10 parts of polyvinyl butyral resin were dispersed together with 120 parts of cyclohexane with a sand mill equipment for 10 hours, preparing a dispersion. To this dispersion, 30 parts of methyl ethyl ketone was added, and the solution obtained was applied onto the above-mentioned undercoating to form an electric charge generating layer with a film thickness of 0.1 $\mu$m.

Subsequently, 8 parts of a compound having a structure represented by the following formula

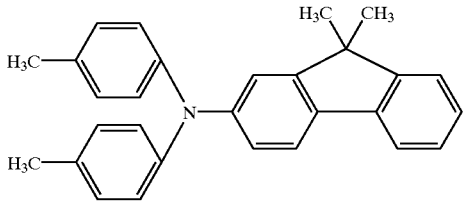

2 parts of a compound having a structure represented by the following formula

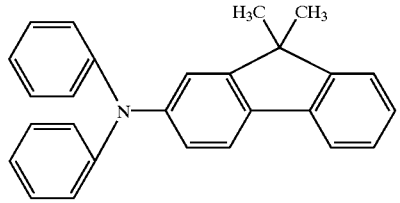

9 parts of a polymer (viscosity-average molecular weight $4.0 \times 10^4$) having a repeating unit represented by the following formula

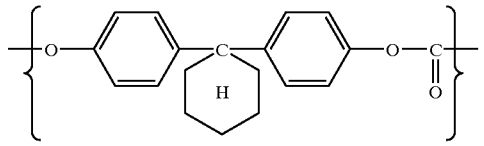

and and 1 part of a copolymer (viscosity-average molecular weight $4.2 \times 10^4$) having repeating units represented by the following formulas (a), (b) and (c)

(a)

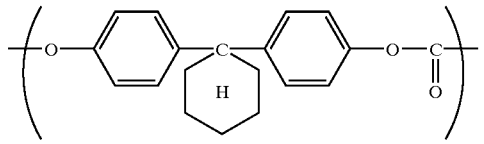

(b)

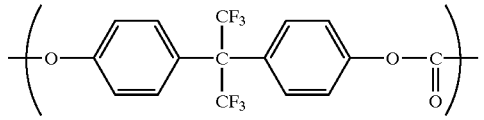

(c)

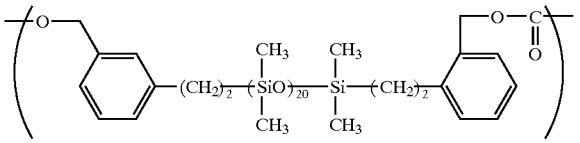

in which the component (a) is 45% by weight and a component (b) is 45% by weight, based on the total weight of the copolymer, were dissolved in a mixed solvent of 20 parts of dichloromethane/40 parts of monochlorobenzene, and thus an electric charge transportation layer was prepared. This coating material was applied by a dip coating method on the above-mentioned electric charge generating layer, was dried for 60 minutes at 120° C., and thus an electric charge transportation layer whose film thickness is 25 μm was formed, preparing an electrophotographic photosensitive member.

The Fischer hardness and the NESA sensitivity of the electrophotographic photosensitive member thus prepared was 240 N/mm$^2$ and 2300 V·cm$^2$/μJ, respectively.

EXAMPLE 1–2

The electrophotographic photosensitive member was prepared in the same way as in Example 1—1 except that a hydroxy gallium phthalocyanine pigment with a crystal form having a strong peak at 7.3 degrees, 24.9 degrees and 28.1 degrees corresponding to a Bragg angle 2θ±0.2 degrees in CuKα characteristics X-rays diffraction was substituted for the hydroxy titanium phthalocyanine pigment with a crystal form having a strong peak at 9.0 degrees, 14.2 degrees, 23.9 degrees and 27.1 degrees corresponding to a Bragg angle 2θ±0.2 degrees in CuKα characteristics X-rays diffraction used in Example 1—1, and the film thickness of the electric charge generating layer was set to be 0.12 μm. The NESA sensitivity of this electrophotographic photosensitive member was 3100 V·cm$^2$/μJ.

EXAMPLE 1–3

An electrophotographic photosensitive member was produced in the same way as in Example 1–2, except that the film thickness of the electric charge generating layer was set to be 0.15 μm. The NESA sensitivity of this electrophotographic photosensitive member was 3600 V·cm$^2$/μJ.

EXAMPLE 1–4

An electrophotographic photosensitive member was produced in the same way as in Example 1–2, except that the film thickness of the electric charge generating layer was set to be 0.22 μm. The NESA sensitivity of this electrophotographic photosensitive member was 4050 V·cm$^2$/μJ.

EXAMPLE 1–5

An electrophotographic photosensitive member was produced in the same way as in Example 1—1, except that a polyarylate (a viscosity-average molecular weight 4.0×10$^4$) having a repetitive structure unit represented by the following formula was substituted for the above-mentioned polymer and copolymer used for the electric charge transportation layer in Example 1—1.

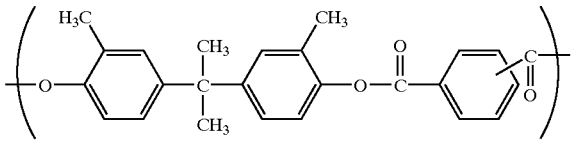

The Fischer hardness of this electrophotographic photosensitive member was 260 N/mm$^2$.

EXAMPLE 1–6

An electrophotographic photosensitive member was produced in the same way as in Example 1—1 except that the film thickness of the electric charge transportation layer was set to be 10 μm.

EXAMPLE 1–7

An electrophotographic photosensitive member was produced in the same way as in Example 1—1 except that the film thickness of the electric charge transportation layer was set to be 30 μm.

EXAMPLE 1–8

An electrophotographic photosensitive member was produced in the same way as in Example 1—1 except that the film thickness of the electric charge transportation layer was set to be 18 μm.

Comparative Example 1—1

An electrophtographic photosensitive member was produced in the same way as in Example 1—1 except that a bisphenol-A type polycarbonate resin (a viscosity average molecular weight 1.0×10$^4$) was substituted for the above-mentioned polymer and copolymer used for the electric charge transportation layer in Example 1—1. The Fischer hardness of this electrophotographic photosensitive member was 100 N/mm$^2$.

Comparative Example 1–2

An electrophotographic photosensitive member was produced in the same way as in Example 1 except that a quinone pigment was substituted for the hydroxy titanium phthalocyanine pigment with a crystal form having a strong peak at 9.0 degrees, 14.2 degrees, 23.9 degrees, and 27.1 degrees corresponding to a Bragg angle 2θ±0.2 degrees in CuKα characteristics X-rays diffraction. The NESA sensitivity of this electrophotographic photosensitive member was 1000 V·cm$^2$/μJ.

Comparative Example 1–3

An electrophotographic photosensitive member was produced in the same way as in Example 1—1, except that the film thickness of the electric charge transportation layer was set to be 35 μm.

Image evaluation was made after a durability test, in which 10000 sheets were printed in a one-sheet intermittent mode (a mode in which a standstill time was set after printing one sheet), was carried out using the electrophotographic photosensitive members in Example 1-1 to 1-8 and Comparative Examples 1-1 to 1-3 mentioned above.

In the evaluation, a printer with the resolution of 1200 dpi, the laser spot diameter of 80 μm, and the process speed of 120 (mm/s) was used. The conditions were so set as to be the dark portion potential of −700 (V) and the development bias of −500 (V).

In addition, evaluation was made for the line width, the scratch depth on the electrophotographic photosensitive member, the white lines (streaks) in the half tone of one-dot-two-space horizontal lines, and for white streaks, ghost and white spots (slight poor charging brought about in half-tone areas) in a photograph picture for practical use.

The results obtained from the image evaluation are shown in Table 1.

In Table 1,

A: No problem.

B: Only slight problem.

C: Problem occurs.

In the above-mentioned evaluation criteria, C is judged that an effect of the present invention is not fully exhibited.

TABLE 1

| | Discharge current value (μA) | Fischer hardness (N/mm²) | NESA sensitivity (V · cm²/μJ) | Thickness of an electric charge transportation layer (μm) | Line width (μm) | Depth of a blemish (μm) | White crease line | | Ghost | | White spot | |
|---|---|---|---|---|---|---|---|---|---|---|---|---|
| | | | | | | | Half-tone picture | Practical use photograph picture | Half-tone picture | Practical use photograph picture | Half-tone picture | Practical use photograph picture |
| Example 1-1 | 100 | 240 | 2300 | 25 | 180 | 0.69 | B | A | A | A | A | A |
| Example 1-2 | | 242 | 3100 | 23 | 185 | 0.65 | A | A | A | A | A | A |
| Example 1-3 | | 243 | 3650 | 24 | 187 | 0.70 | A | A | A | A | A | A |
| Example 1-4 | | 241 | 4020 | 24 | 190 | 0.63 | A | A | B | A | A | A |
| Example 1-5 | | 260 | 3120 | 22 | 182 | 0.55 | A | A | A | A | A | A |
| Example 1-6 | | 243 | 2270 | 10 | 160 | 0.60 | A | A | A | A | A | A |
| Example 1-7 | | 242 | 3160 | 30 | 180 | 0.65 | A | A | A | A | A | A |
| Example 1-8 | | 245 | 3110 | 18 | 175 | 0.63 | A | A | A | A | A | A |
| Comparative example 1-1 | | 100 | 2300 | 25 | 175 | 1.40 | C | C | A | A | A | A |
| Comparative example 1-2 | | 240 | 1000 | 25 | 175 | 0.72 | C | C | A | A | A | A |
| Comparative example 1-3 | | 240 | 2300 | 35 | 170 | 0.75 | C | C | A | A | A | A |

As shown in Table 1, white streaks were able to be prevented by using the electrophotographic photosensitive members which satisfies the following (1), (2), and (3):

(1) the Fischer hardness is no less than 240 N/mm²

(2) the NESA sensitivity is no less than 2000 V·cm²/μJ (3) the thickness of the electric charge transportation layer is no more than 30 μm.

As described above, a high resolution may be attained with a low cost constitution and streaks in half tone images may be prevented so that photograph pictures with good quality can be obtained, using electrophotographic apparatus in Examples even when a process speed is high.

EXAMPLE 2

In this Example, an electrophotographic apparatus used in Example 1, in which a double beam laser method is used as an exposure means and a discharge current value ΔI given from a charging equipment was set as 40 μA to 80 μA, was used.

In a charging equipment in which charging is performed by contacting with an electrophotographic photosensitive member and by applying an oscillating voltage Vpp, when an inclination of a non-discharging area (an area of no more than 2×Vth) of alternating current VI characteristics is defined as θ, and a current value in charging process is defined as Iac, discharge current value ΔI is defined as:

$$\Delta I = Iac - \theta \times Vpp.$$

The discharge current will be described using FIG. 7.

Figure 7:
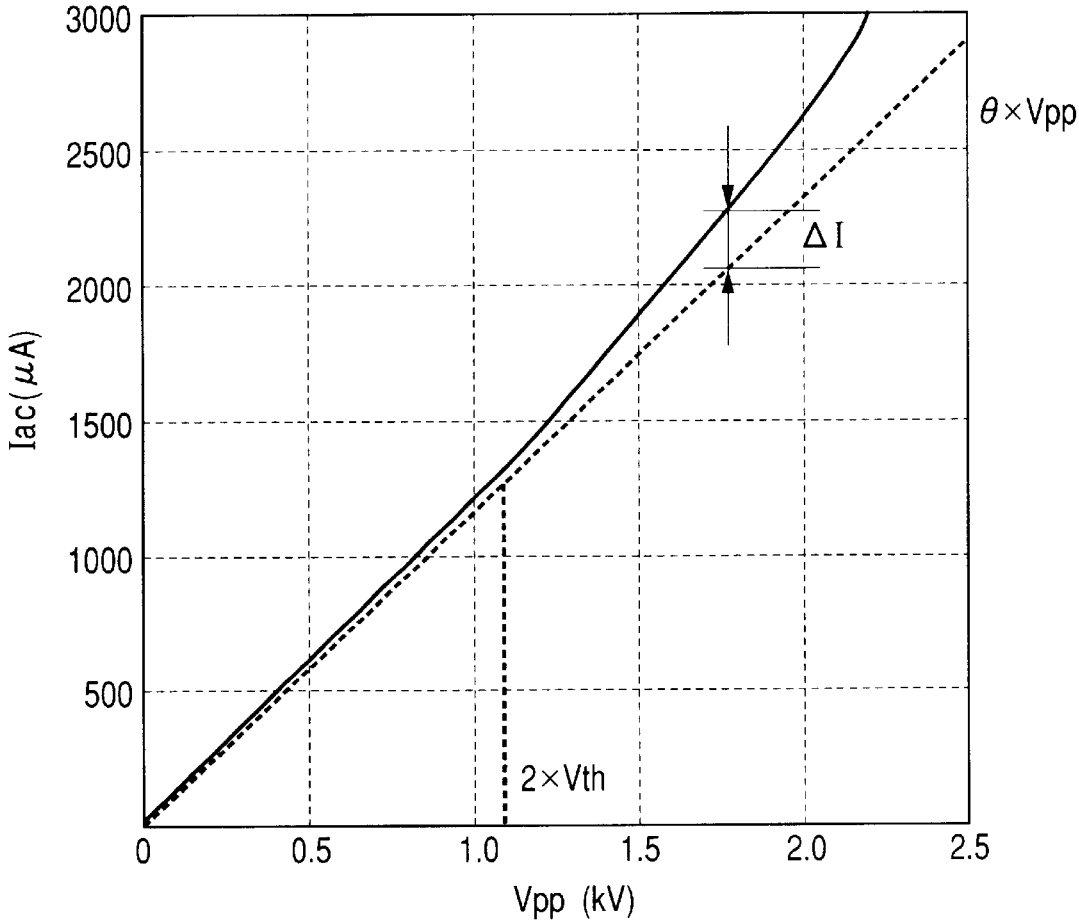
FIG. 7 is a figure explaining a discharge current.

In the graph of FIG. 7, an alternating voltage (peak-to-peak voltage Vpp) applied to a charging roller is taken as the x-axis, and a current value Iac generated when Vpp is applied is taken as the y-axis (hereinafter, the characteristics appearing in the graph are referred to as alternating current VI characteristics). Alternating current VI characteristics vary linearly in an area to twice of discharge starting voltage Vth, when a direct current is applied to the charging roller. With more than this value, the characteristics vary non-linearly in the increasing direction of the current. This means that a current caused by discharge in addition to a current caused by induced charges flows in an impedance part between the charging roller and the electrophotographic photosensitive member. Therefore, the whole current value (Iac) minus the current value (θ×Vpp) equals the discharge current value ΔI.

Figure 8:
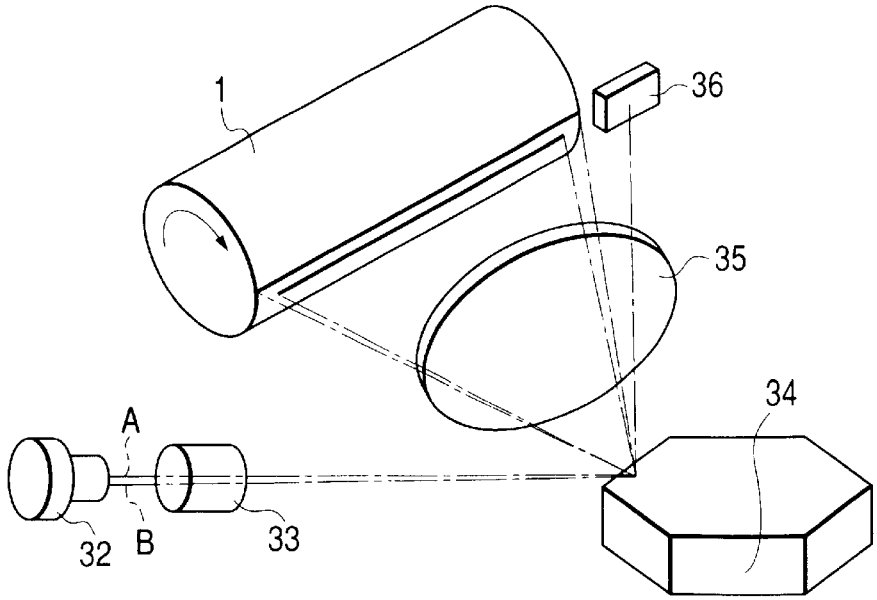
FIG. 8 is a diagram of a double beam laser of Example 2 in the present invention.

Next, the latent image formation method in the double beam laser method will be described using FIG. 8.

From a double beam laser 32, two laser beams are emitted, and after passing through a collimator lens 33, they are polarized by a polygon 34 and applied to scanning. The laser beams are operated by an fθ lens 35 for correcting a scanning speed of the laser light, and a position sensor 36 for detecting image signal write start in the main scanning direction on the electrophotographic photosensitive member 1. Since two lasers are used simultaneously, scanning with two lines are performed.

Figure 9:
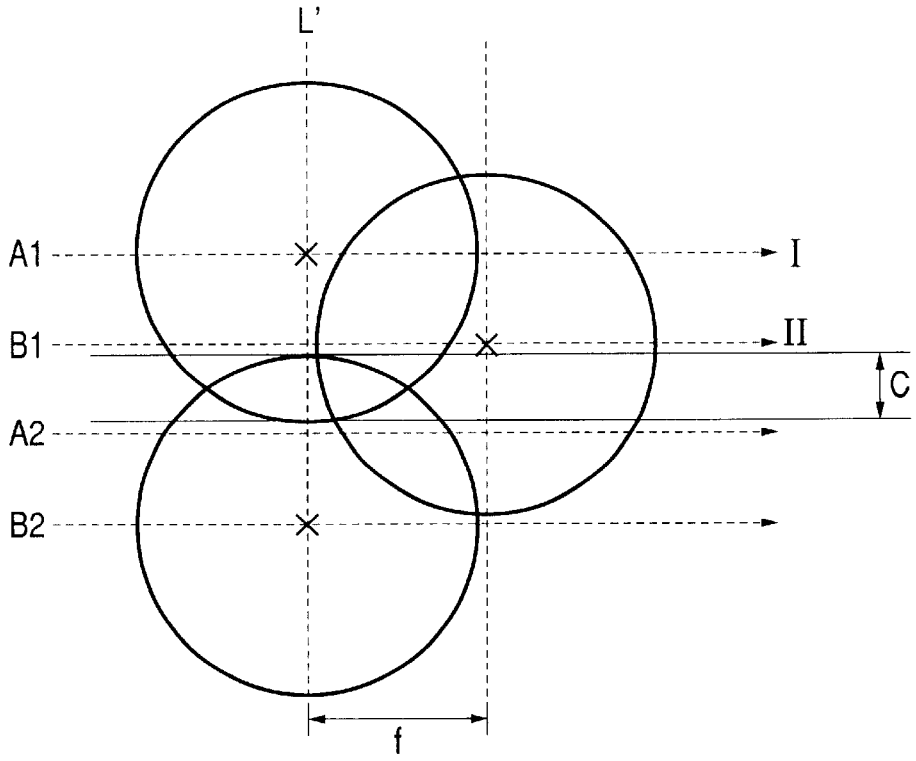
FIG. 9 is a figure explaining a double beam laser.

FIG. 9 shows an image figure of a laser beam with which the electrophotographic photosensitive member surface is scanned. In a certain time, if a first laser A is scanning position I, a second laser B will be scanning position II later than the first laser. Since scanning is carried out at a certain fixed speed, these laser beams have always a position gap f between them in the direction of scanning.

In an electrophotographic apparatus using a double laser method, when the spot diameter of an exposure beam is larger in comparison with a pixel density, streak-like images may be explicit in some cases.

Figure 10:
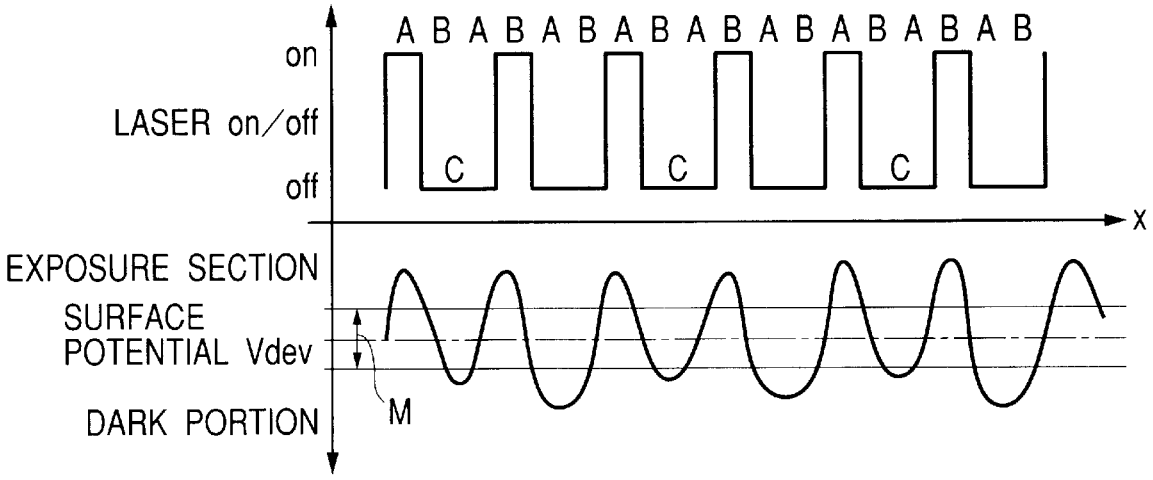
FIG. 10 is a figure explaining a static latent image pattern.

FIG. 10 shows a latent image pattern of a half tone of one-dot-two-space horizontal lines cited as a specific example. The latent image pattern was formed on the circumference of the section L shown in FIG. 9. Hereinafter, description will be given using this figure.

With half tone images formed in the double beam method, there is a case where the emission timing of laser A and the emission timing of laser B are close to each other (scanning line A1 and scanning line B2), and a potential at an overlapping portion C tends to fall. Thereby, the surface potential unevenness in half-tone potential will become small and a middle area M between a light portion potential and a dark portion potential spreads. Therefore, compared with a printer with a single laser, image defects is liable to occur due to even small noise in latent images. Therefore, in order to reduce white streaks, the scratch depth on the electrophotographic photosensitive member surface needs to be controlled smaller.

According to examinations of the present inventor, it turned out that a streak-like image in a half tone becomes distinguished when the scratch depth on the electrophotographic photosensitive member surface is no less than 0.75 $\mu$m, hence the scratch depth should be so controlled to be no more than 0.6 $\mu$m for preventing streak-like images.

Figure 11:
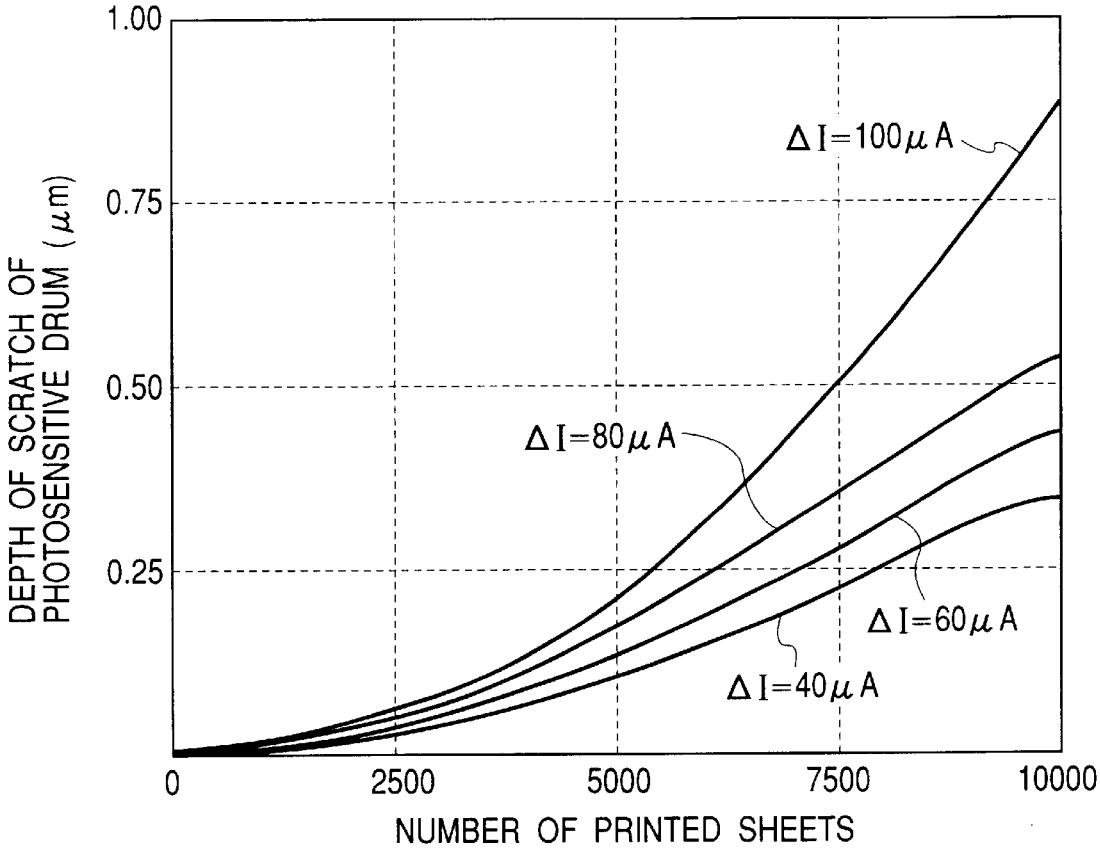
FIG. 11 is a figure explaining the relationship between a discharge current and a scratch of an electrophotographic photosensitive member.

In addition, the durability test result showed that the scratch on the electrophotographic photosensitive member surface has a correlation with the amount of discharge of a charging roller. FIG. 11 is a graph showing the relationship between discharge current and the scratch depth on the electrophotographic photosensitive member surface with the number of printed sheets in a durability test. The apparatus used in this case was a printer of the double beam system with the laser spot diameters of 80 $\mu$m, the resolution of 1200 dpi, the process speed of 300 mm/s, and the Fischer hardness of electrophotographic photosensitive member of 240 N/mm$^2$. Printing was performed in a one-sheet intermittent mode (a mode in which a standstill time was set after printing one sheet), and the scratch depth on the electrophotographic photosensitive member surface was measured.

This figure shows that even in an electrophotographic apparatus using a double beam printer, the scratch depth on the electrophotographic photosensitive member surface can be so controlled as to be no more than 0.6 $\mu$m by setting the amount of discharge in a charging equipment to be no more than 80 $\mu$A. The reason that the scratch depth on the electrophotographic photosensitive member surface depends on discharge current is presumed to be that discharge deteriorates the surface layer of the electrophotographic photosensitive member to lower its mechanical strength.

Next, the charging equipment 2' used in this example will be described below in detail.

Figure 12:
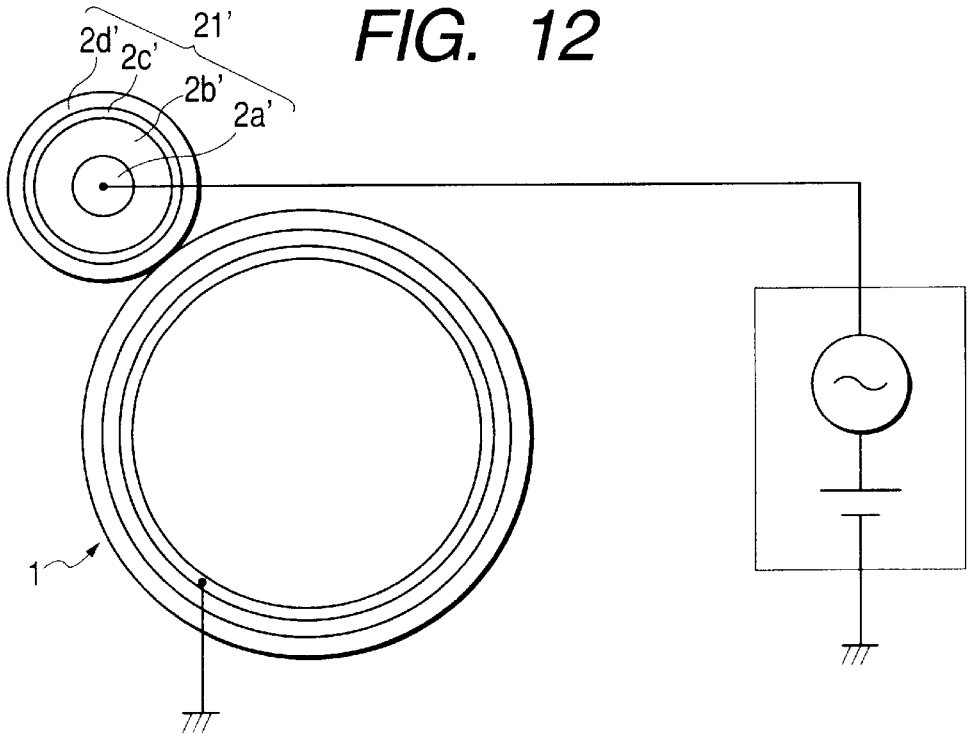
FIG. 12 is an outline block diagram of a charging equipment used in Example 2 of the present invention.

In FIG. 12, reference numeral 2*a*' denotes a conductive shaft-like support made of metal or plastics that serves also as an electric supply component. An elastic layer 2*b*', a resistance layer 2*c*', and a protective layer 2*d*' are formed sequentially on the above-mentioned conductive support to constitute a charging roller 21' with a diameter of about 12 mm.

As the elastic layer 2*b*', rubber such as polyurethane rubbers, silicone rubbers, NBR's, and epichlorohydrin rubbers, or a mixture thereof may be used. A foamed rubber material with a lower hardness may be used. A suitable conductivity is imparted to these elastic layer components by dispersing a conductive material, such as carbon black or metal oxides.

As the resistance layer 2*c*', resins such as acrylate resins, acrylics modified urethanes, polyamides and fluoroplastics, may be used in addition to rubber materials such as polyurethane rubbers, silicone rubbers, NBR and epichlorohydrin rubbers. A suitable conductivity is imparted to these materials by dispersing appropriate conductive materials such as carbon black and metal oxides, forming the resistance layer. The thickness of the resistance layer is preferably 1 $\mu$m to 1 mm, and especially preferably about 100 $\mu$m to 800 $\mu$m.

As the protection layer 2*d*', resins such as acrylate resins, acrylics modified urethanes, polyamides, and fluoroplastics, or a mixture thereof may be used. A suitable conductivity is given to these materials by dispersing conductive materials such as carbon black and metal oxides. It is preferred that the protection layer has a thickness of about 3 $\mu$m to 20 $\mu$m.

The charging roller thus obtained is so fixed as to be in contact with the electrophotographic photosensitive member 1 while maintaining a certain pressure by a terminal supported with a spring (not shown) at the end of the charging roller.

A voltage is applied to the charging roller 21' through an electric supply means (not shown) from a primary voltage power source. A direct current component of the primary voltage impresses a voltage equal to an electric potential that charges the electrophotographic photosensitive member surface. A voltage of about −700 V is impressed in this example. In the present invention, an alternating current value at the primary voltage is set so that a discharge current value $\Delta I$ may be 30 $\mu$A to 80 $\mu$A, and preferably 40 $\mu$A to 60 $\mu$A.

Figure 13:
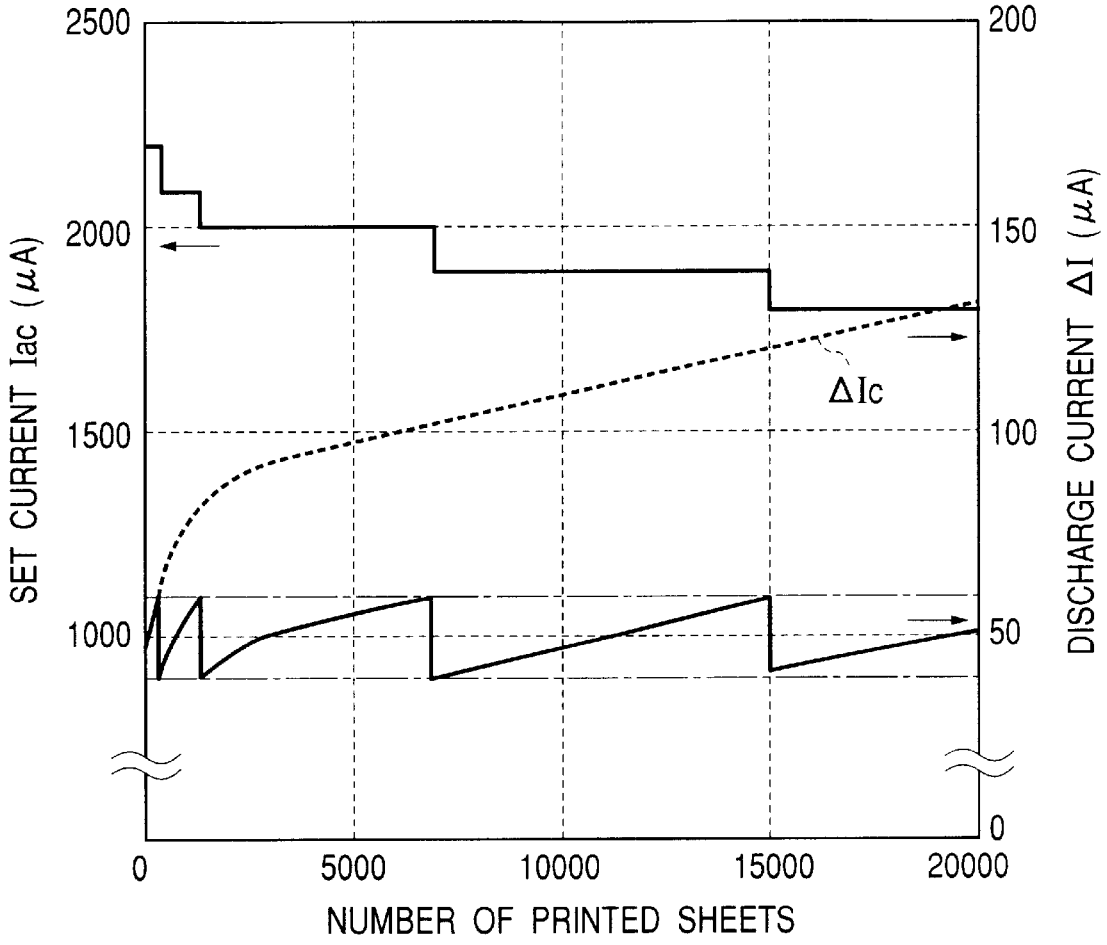
FIG. 13 is a diagram of the relationship between the set and discharge currents and the number of printed sheets.

The discharge current value is controlled in this example by switching over a set current value as shown in FIG. 13.

Specifically, in an initial state, control is performed with the current value of 2200 $\mu$A so that a frequency may be set to be 2400 Hz and a discharge current value $\Delta I$ may be set to be 40 $\mu$A. In extensive operation, the discharge current value varies depending on contamination on the charging roller or on how the electric charge transportation layer of the electrophotographic photosensitive member is worn (curve $\Delta Ic$). Therefore, history information such as the number of sheets printed in the electrophotographic apparatus is recorded and a transition state of VI curve are measured beforehand, and a formula and a table representing the relationship between the number of printed sheets and the current value are memorized in a memory means in the apparatus, whereby the discharge current value is controlled in the range of 40 $\mu$A to 60 $\mu$A. Thus, the setting current value is switched according to the number of printed sheets.

As explained above, high-definition may be attained and streak-like images in half tone images can be prevented, obtaining photograph pictures with excellent quality even in a laser beam printer using a plurality of exposure beams with an inexpensive constitution, by the use of the electrophotographic apparatus of this example.

Moreover, the present invention is not limited to the apparatus having two scanning lines, and may be applied to multi-laser beam methods with two or more beams.

Specific embodiments are described below.

EXAMPLE 2–1 to 2–8,

Comparative Example 2–1 to 2–3

Evaluation was made using the same electrophotographic photosensitive member as used in Examples 1—1 to 1–8 and Comparative Examples 1—1 to 1–3 except that a printer (in which discharge current value $\Delta I$ is set at 80 $\mu$A) using a double-beam method and having the laser spot diameter of 80 μm, the resolution of 1200 dpi and the process speed of 300 mm/s was used.

EXAMPLE 2–9

Evaluation was made in the same way as in Example 2—2, except that the discharge current value ΔI was set at 100 μA.

EXAMPLE 2–10

Evaluation was made in the same way as in Example 2—2, except that the discharge current value ΔI was set at 30 μA.

The image evaluation results are shown in Table 2.

TABLE 2

| | Discharge current value (μA) | Fischer hardness (N/mm²) | NESA sensitivity (V · cm²/μJ) | Thickness of an electric charge transportation layer (μm) | Line width (μm) | Depth of a blemish (μm) | White crease line | | Ghost | | White spot (*) | |
|---|---|---|---|---|---|---|---|---|---|---|---|---|
| | | | | | | | Half-tone picture | Practical use photograph picture | Half-tone picture | Practical use photograph picture | Half-tone picture | Practical use photograph picture |
| Example 1-1 | 80 | 240 | 2280 | 25 | 182 | 0.55 | B | A | A | A | A | A |
| Example 1-2 | | 241 | 3210 | 23 | 188 | 0.52 | A | A | A | A | A | A |
| Example 1-3 | | 242 | 3620 | 22 | 190 | 0.55 | A | A | A | A | A | A |
| Example 1-4 | | 260 | 4050 | 23 | 195 | 0.50 | A | A | B | A | A | A |
| Example 1-5 | | 242 | 3130 | 24 | 185 | 0.43 | A | A | A | A | A | A |
| Example 1-6 | | 241 | 2290 | 10 | 162 | 0.47 | A | A | A | A | A | A |
| Example 1-7 | | 243 | 3170 | 30 | 175 | 0.53 | A | A | A | A | A | A |
| Example 1-8 | | 244 | 3130 | 18 | 170 | 0.57 | A | A | A | A | A | A |
| Example 1-9 | 100 | 241 | 3180 | 25 | 183 | 0.85 | B | A | A | A | A | A |
| Example 1-10 | 30 | 241 | 3140 | 25 | 185 | 0.35 | A | A | A | A | A | A |
| Example 1-11 | 10 | 243 | 3100 | 22 | 177 | 0.20 | A | A | A | A | B | A |
| Comparative example 1-1 | 80 | 120 | 3250 | 23 | 177 | 0.96 | C | C | A | A | A | A |
| Comparative example 1-2 | | 243 | 1200 | 22 | 170 | 0.44 | C | C | A | A | A | A |
| Comparative example 1-3 | | 240 | 3130 | 25 | 173 | 0.59 | C | C | A | A | A | A |

EXAMPLE 3

Figure 14:
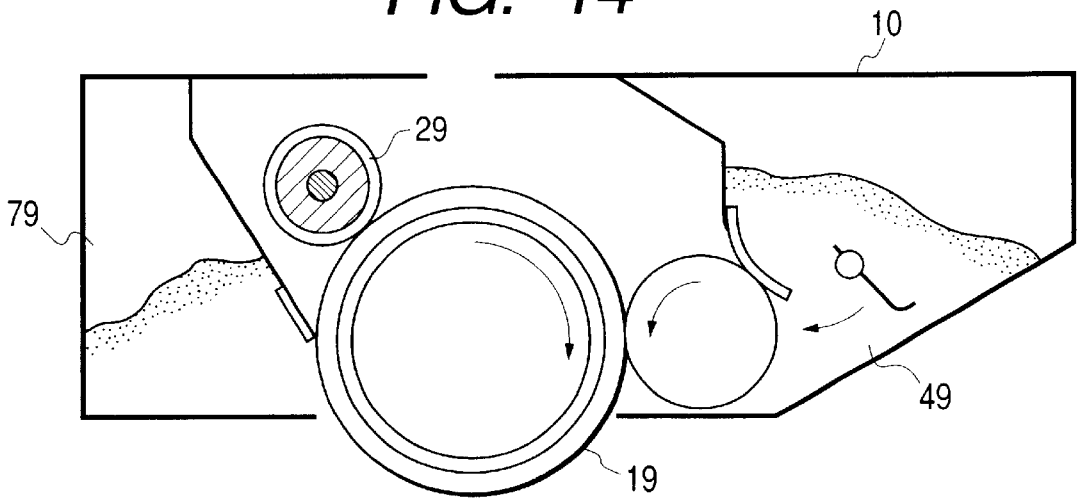
FIG. 14 is an outline block diagram of a process cartridge of the present invention.
Figure 15:
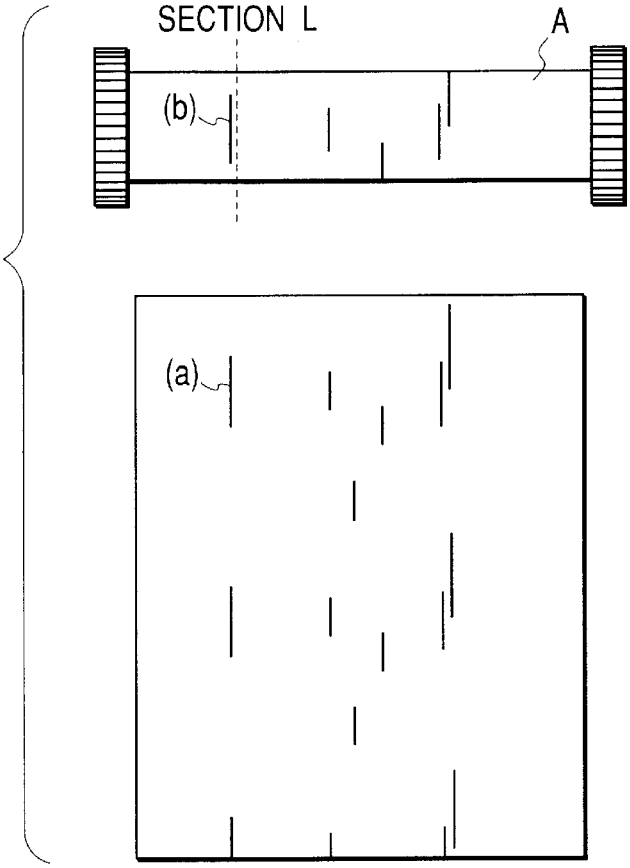
FIG. 15 is a diagram explaining the problem of prior art.
Figure 16:
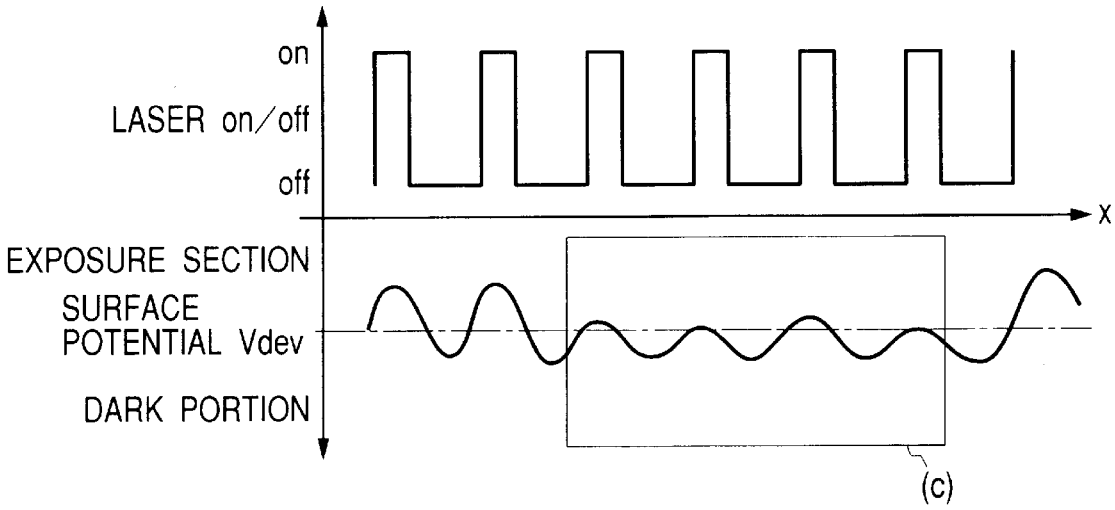
FIG. 16 is another diagram explaining the problem of prior art.

Next, based on FIG. 14, a description will be given concerning the process cartridge of the present invention with an example of its outline constitution.

The process cartridge 10 of this Example is made as one unit by combining the above-mentioned electrophotographic photosensitive member 19, a charging roller 29, a developer 49, and a cleaning equipment 79.

These components are incorporated having a predetermined configuration relationship in the process cartridge 10, and the process cartridge 10 is inserted and installed in a predetermined way in the predetermined part of the electrophotographic apparatus. Moreover, the cartridge can be pulled out of the main body of the apparatus, so that it can be mounted on, and detached from, the main body of the apparatus.

When the electrophotographic apparatus is used for a long period of time, various components, such as the electrophotographic photosensitive member, the charging equipment, the developer, and the cleaning equipment, would be worn out, and printing quality may be impaired. In such a case, a user can conveniently exchange the process cartridge for new one, thus a maintenance-free system for a user can be realized.

As explained above, even in electrophotographic apparatus having high resolution and used at a high process speed, while having an inexpensive constitution, image defects were able to be prevented from occurring, and it became possible to output and maintain photograph pictures with good quality.

Also in printers with a multi-beam method, it became also possible to output and maintain photograph pictures with good quality.

Furthermore, the process cartridge provided with the electrophotographic photosensitive member according to the present invention has enabled stable printing by electrophotography to be effected, and also maintenance to be practiced easily.

What is claimed is:

1. An electrophotographic apparatus comprising an electrophotographic photosensitive member and exposure means for forming a static latent image on the surface of the electrophotographic photosensitive member by scanning with an exposure beam based on picture information, the spot diameter of the exposure beam being 2.5 times or more the size of one pixel of an image formed by the electrophotographic apparatus, wherein a Fischer hardness of the surface of the electrophotographic photosensitive member is no less than 240 $Ns/mm^2$, a NESA sensitivity of the electrophotographic photosensitive member is no less than 2000 $V \cdot cm^2/\mu J$, the electrophotographic photosensitive member comprises at least an electric charge generating layer and an electric charge transportation layer, and a thickness of the electric charge transportation layer is no more than 30 $\mu m$.

2. The electrophotographic apparatus according to claim 1, wherein a process speed of said electrophotographic photosensitive member is no less than 100 mm/s.

3. The electrophotographic apparatus according to claim 1, wherein said exposure means forms a static latent image on the electrophotographic photosensitive member by scanning with a plurality of exposure beams based on image information.

4. The electrophotographic apparatus according to claim 1, further comprising charging means for charging the surface of the electrophotographic photosensitive member by applying an oscillating voltage to a charging member in contact with the electrophotographic photosensitive member, in which a peak-to-peak voltage of the oscillating voltage is twice or more as high as a charging starting voltage Vth when applying a DC voltage to the charging member.

5. The electrophotographic apparatus according to claim 1, further comprising charging means for charging the surface of the electrophotographic photosensitive member by applying an oscillating voltage to a charging member in contact with the electrophotographic photosensitive member, in which a discharge current ΔI satisfies the following conditions:

$$30\ \mu A \leqq \Delta I \leqq 80\ \mu A,$$

wherein $\Delta I = Iac - \theta \times Vpp$ in which

Vpp represents the oscillating voltage,

Iac represents a generated current, and

θ represents a ratio of a current to a voltage twice or less as high as a charging starting voltage in alternating current VI characteristics in a state that the electrophotographic photosensitive member and the charging member are in contact with each other.

6. A process cartridge which supports as one unit an electrophotographic photosensitive member in which a static latent image is formed on its surface by scanning with an exposure beam from exposure means based on image information, and at least one means selected from the group consisting of developing means, cleaning means and charging means, and can be mounted on, and detached from, a main body of an electrophotographic apparatus, wherein a spot diameter of the exposure beam is 2.5 times or more the size of one pixel of an image formed by the electrophotographic apparatus, a Fischer hardness of the surface of the electrophotographic photosensitive member is no less than 240 $Ns/mm^2$, a NESA sensitivity of the electrophotographic photosensitive member is no less than 2000 $V \cdot cm^2/\mu J$, the electrophotographic photosensitive member comprises at least an electric charge generating layer and an electric charge transportation layer, and a thickness of said electric charge transportation layer is no more than 30 $\mu m$.

7. The process cartridge according to claim 6, wherein a process speed of the electrophotographic photosensitive member is no less than 100 mm/s.

8. The process cartridge according to claim 6, wherein said exposure means forms a static latent image on said electrophotographic photosensitive member by scanning with a plurality of exposure beams based on image information.

9. The process cartridge according to claim 6, further comprising charging means for charging the surface of the electrophotographic photosensitive member by applying an oscillating voltage to a charging member in contact with the electrophotographic photosensitive member, in which a peak-to-peak voltage of the oscillating voltage is twice or more as high as a charging starting voltage Vth when applying a direct current voltage to the charging member.

10. The process cartridge according to claim 6, further comprising charging means for charging the surface of the electrophotographic photosensitive member by applying an oscillating voltage to a charging member in contact with the electrophotographic photosensitive member, in which a discharge current ΔI satisfies the following conditions:

$$30\ \mu A \leqq \Delta I \leqq 80\ \mu A,$$

wherein $\Delta I = Iac - \theta \times Vpp$ in which

Vpp represents the oscillating voltage,

Iac represents a generated current, and

θ represents a ratio of a current to a voltage twice or less as high as a charging starting voltage in alternating current VI characteristics in a state that the electrophotographic photosensitive member and the charging member are in contact with each other.

11. An electrophotographic photosensitive member in which a static latent image is formed on its surface by scanning with an exposure beam from exposure means based on image information, wherein a spot diameter of the exposure beam is 2.5 times or more the size of one pixel of an image formed using the electrophotographic photosensitive member, a Fischer hardness of the surface of the electrophotographic photosensitive member is no less than 240 $Ns/mm^2$, a NESA sensitivity of the electrophotographic photosensitive member is no less than 2000 $V \cdot cm^2/\mu J$, the electrophotographic photosensitive member comprises at least an electric charge generating layer and an electric charge transportation layer, and a thickness of said electric charge transportation layer is no more than 30 $\mu m$.

12. The electrophotographic photosensitive member according to claim 11, wherein the electrophotographic photosensitive member has a process speed of no less than 100 mm/s.

13. The electrophotographic photosensitive member according to claim 11, wherein a static latent image is formed on the surface of the electrophotographic photosensitive member by scanning with a plurality of exposure beams from exposure means based on image information.

14. The electrophotographic photosensitive member according to claim 11, wherein charging means charges the surface of the electrophotographic photosensitive member by applying an oscillating voltage to a charging member in contact with the electrophotographic photosensitive member, in which a peak-to-peak voltage of the oscillating voltage is twice or more as high as a charging starting voltage Vth when applying a direct current voltage to the charging member.

15. The electrophotographic photosensitive member according to claim 11, wherein charging means charges the surface of the electrophotographic photosensitive member by applying an oscillating voltage to a charging member in contact with the electrophotographic photosensitive member, in which a discharge current ΔI satisfies the following conditions:

$$30\ \mu A \leqq \Delta I \leqq 80\ \mu A,$$

wherein $\Delta I = Iac - \theta \times Vpp$ in which

Vpp represents the oscillating voltage,

Iac represents a generated current, and

θ represents a ratio of a current to a voltage twice or less as high as a charging starting voltage in alternating current VI characteristics in a state that the electrophotographic photosensitive member and the charging member are in contact with each other.

* * * * *

UNITED STATES PATENT AND TRADEMARK OFFICE

CERTIFICATE OF CORRECTION

PATENT NO. : 6,549,223 B2
DATED : April 15, 2003
INVENTOR(S) : Kazumi Yamauchi

It is certified that error appears in the above-identified patent and that said Letters Patent is hereby corrected as shown below:

Title page,
Item[57], ABSTRACT:
Line 5, "an" (2nd occurrence) should be deleted.

Column 1,
Line 14, "a" should read -- an --.
Line 22, "are" should read -- have --.

Column 2,
Line 31, "high" should read -- highly --.
Line 32, "equipments," should read -- equipment, --.

Column 5,
Line 29, "remained" should read -- remaining --.
Line 30, "off " should be deleted.

Column 9,
Line 17, "hydoroxy" should read -- hydroxy --.

Column 12,
Line 58, "are" should read -- is --.

Column 14,
Line 43, "are" should read -- is --.

Signed and Sealed this

Twenty-fifth Day of May, 2004

JON W. DUDAS
*Acting Director of the United States Patent and Trademark Office*